US008291533B2

(12) United States Patent
Teeter

(10) Patent No.: US 8,291,533 B2
(45) **Date of Patent: *Oct. 23, 2012**

(54) PATIENT TREATMENT APPARATUS

(76) Inventor: Roger C. Teeter, Sumner, WA (US)

( * ) Notice: Subject to any disclaimer, the term of this patent is extended or adjusted under 35 U.S.C. 154(b) by 577 days.

This patent is subject to a terminal disclaimer.

(21) Appl. No.: 12/460,027

(22) Filed: Jul. 10, 2009

(65) Prior Publication Data

US 2011/0004995 A1 Jan. 13, 2011

(51) Int. Cl.
*A61G 13/04* (2006.01)

(52) U.S. Cl. ..... 5/611; 511/11; 511/610; 511/624

(58) Field of Classification Search ..... 5/11, 611, 5/610, 613, 616, 621, 624
See application file for complete search history.

(56) References Cited

U.S. PATENT DOCUMENTS 4,144,880 A 3/1979 Daniels
4,672,697 A * 6/1987 Schurch ..... 5/610
4,724,555 A * 2/1988 Poehner et al. ..... 5/624
4,751,754 A * 6/1988 Bailey et al. ..... 5/611
4,894,876 A * 1/1990 Fenwick ..... 5/602
4,913,424 A 4/1990 Pepin
4,915,101 A * 4/1990 Cuccia ..... 606/244
5,054,141 A * 10/1991 Foster et al. ..... 5/611
5,794,286 A 8/1998 Scott et al.
6,637,055 B1 * 10/2003 Nanan ..... 5/610
6,862,762 B1 * 3/2005 Johnson et al. ..... 5/601
7,472,441 B1 * 1/2009 Steffensmeier ..... 5/610
8,051,512 B2 * 11/2011 Teeter ..... 5/618
8,065,764 B2 * 11/2011 Kramer ..... 5/624
2006/0042010 A1 * 3/2006 Lee ..... 5/610
2009/0300845 A1 * 12/2009 Paz et al. ..... 5/610

* cited by examiner

*Primary Examiner* — William Kelleher
(74) *Attorney, Agent, or Firm* — Charles E. Baxley

(57) ABSTRACT

A patient treatment device includes an upper cantilever member and a lower cantilever member pivotally coupled to a platform, a bracket pivotally coupled to the front portions of the cantilever members for forming a parallelogrammic device, an elevating transmission device for pivoting the cantilever members up and down relative to the platform, a patient supporting table including a front portion pivotally attached to the bracket, and a tilting transmission device for tilting the patient supporting table between the horizontal position and the tilted working position and for preventing the patient from falling down from the patient supporting table inadvertently.

12 Claims, 10 Drawing Sheets

PATIENT TREATMENT APPARATUS

BACKGROUND OF THE INVENTION

1. Field of the Invention

The present invention relates to a patient treatment apparatus, and more particularly to a patient treatment apparatus including a stable support for stably elevating the patient supporting table and for preventing the patient supporting table from being tilted or inclined relative to the supporting base and also for preventing the patient from falling down from the patient supporting table inadvertently.

2. Description of the Prior Art

Typical patient treatment apparatuses comprise a patient supporting table for supporting the patient thereon and for applying controlled flexion and traction to a patient's body.

For example, U.S. Pat. No. 4,144,880 to Daniels discloses one of the typical orthopedic tables comprising a patient supporting table including harnessed opposite ends, and a pelvic straps on the lower platform secure the patient's pelvic region to the lower platform.

However, the patient supporting table may not be elevated relative to the supporting base, and also may not be tilted or inclined relative to the supporting base.

U.S. Pat. No. 4,913,424 to Pepin discloses another typical slant board with automatic foot release and comprising a patient supporting table rotatable upon a horizontal axis from a horizontal position to a near vertical position.

However, similarly, the patient supporting table also may not be elevated relative to the supporting base such that the patient may not be suitably lowered or elevated relative to the supporting base to the required height.

U.S. Pat. No. 4,915,101 to Cuccia discloses a further typical rotatable treatment table including a weighted platform adapted to rest upon a floor, and rigid support elements pivotally attached or supported on the weighted platform and rotatable relative to the weighted platform with an extensible elevation member.

However, similarly, the rigid support elements also may not be elevated relative to the weighted platform such that the patient may not be suitably lowered or elevated relative to the weighted platform to the required height.

U.S. Pat. No. 5,794,286 to Scott et al. discloses a still further typical patient treatment apparatus including an elongated table pivotally attached or supported on a bottom or base with a pivotal table support column and rotatable relative to the base with a pusher block assembly.

However, the pusher block assembly include a weak structure that may not stably support the elongated table on the pivotal table support column and the elongated table and the patient supported on the elongated table may have a good chance to be tilted or inclined relative to the supporting base.

U.S. Pat. No. 6,637,055 to Nanan discloses a still further yoga inversion bed with leg attachment and pivotable from a horizontal arrangement to a vertical arrangement to controllably invert a human body from a supine position to an inverted position.

However, the patient supporting table also may not be elevated relative to the supporting base such that the patient may not be suitably lowered or elevated relative to the supporting base to the required height.

The present invention has arisen to mitigate and/or obviate the afore-described disadvantages of the conventional patient treatment apparatuses.

SUMMARY OF THE INVENTION

The primary objective of the present invention is to provide a patient treatment apparatus including a stable support for stably elevating the patient supporting table and for preventing the patient supporting table from being tilted or inclined relative to the supporting base and also for preventing the patient from falling down from the patient supporting table inadvertently.

In accordance with one aspect of the invention, there is provided a patient treatment apparatus comprising a platform including a rear portion, an upper cantilever member and a lower cantilever member pivotally attached and coupled to the rear portion of the platform with pivot poles, and each including a front portion, a bracket pivotally attached and coupled to the front portions of the upper and the lower cantilever members with pivot axles respectively for allowing the upper and the lower cantilever members and the bracket to be formed as a parallelogrammic device and for allowing the upper and the lower cantilever members to be pivoted up and down relative to the platform with the pivot poles, an elevating transmission device including a tube, and a motor-driven rod slidably received and engaged in the tube and coupled between the platform and the parallelogrammic device for pivoting the upper and the lower cantilever members up and down relative to the platform, a patient supporting table including a front portion pivotally attached and coupled to the bracket of the parallelogrammic device for allowing the patient supporting table to be pivoted relative to the parallelogrammic device between a horizontal position and a tilted working position, and a tilting transmission device including a tube, and a motor-driven rod slidably received and engaged in the tube and coupled between the patient supporting table and the parallelogrammic device for tilting the patient supporting table between the horizontal position and the tilted working position.

The platform includes a column extended upwardly from the rear portion of the platform, and the pivot poles are attached to the column and arranged one above the other.

The upper cantilever member includes two side beams each having a bent front segment formed on a front portion of each of the side beams. The lower cantilever member includes two side beams each having a bent rear segment formed on a rear portion of each of the side beams.

The elevating transmission device includes a seat having a lower portion pivotally attached and coupled to the platform with a pivot pin, and the tube is extended upwardly from the seat and the rod is slidably received and engaged in the tube and coupled to the parallelogrammic device.

The parallelogrammic device includes a lateral bar attached to the upper cantilever member for supporting the pivot pin. The lateral bar includes an upwardly bent structure for supporting the pivot pin above the upper cantilever member.

The tilting transmission device includes a seat having a lower portion pivotally attached and coupled to the bracket with a pivot pin, and the tube is extended upwardly from the seat and the rod is slidably received and engaged in the tube and coupled to the patient supporting table. The bracket includes a framework attached to the bracket for supporting the pivot pin.

The patient supporting table includes a foot retaining device attached to the patient supporting table for engaging with a user's feet and for anchoring and retaining the user on the patient supporting table.

The patient supporting table includes a table segment having a front portion pivotally attached and coupled to the bracket of the parallelogrammic device with the pivot axle, and includes a head segment coupled to the table segment.

The table segment includes an extension extended forwardly therefrom for engaging with an ear of the head segment and for coupling the head segment to the table segment.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
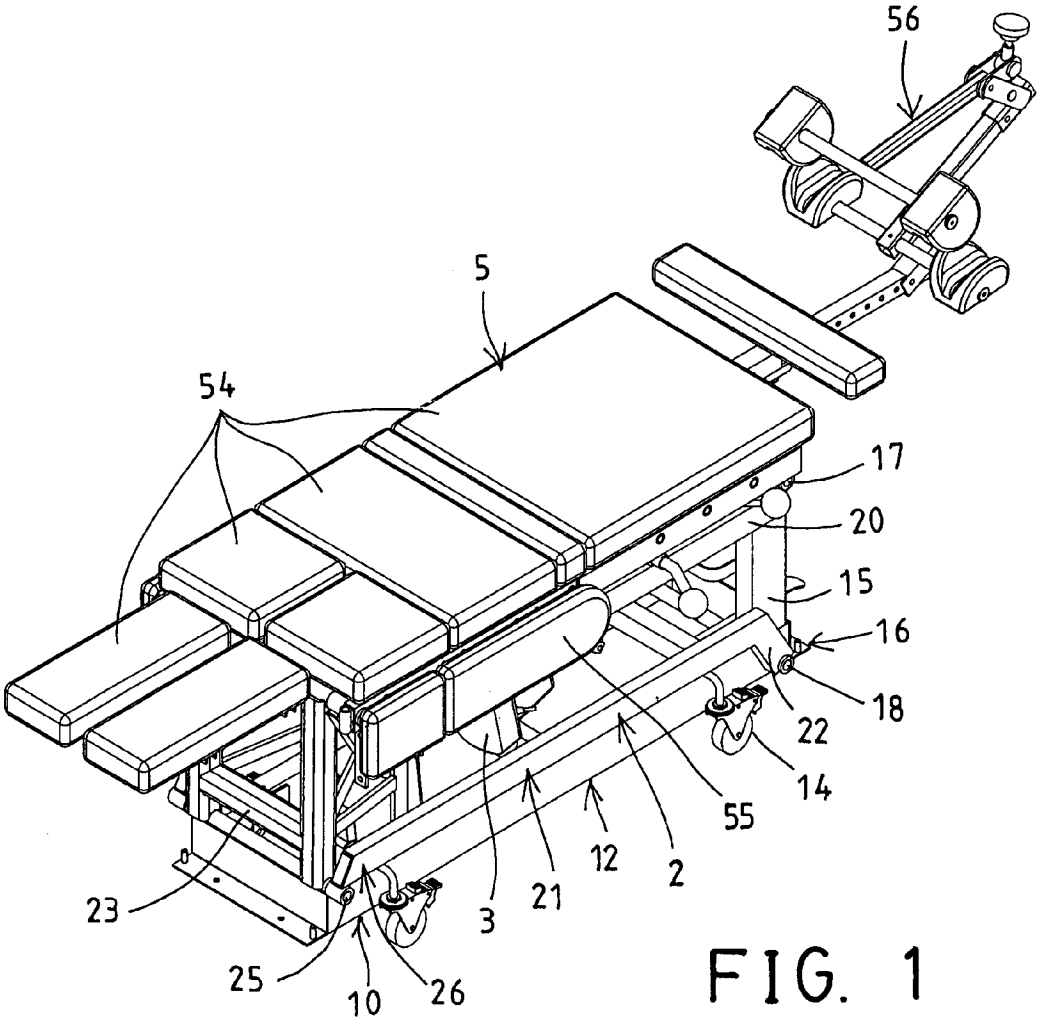
FIG. 1 is a perspective view of a patient treatment apparatus in accordance with the present invention.
Figure 2:
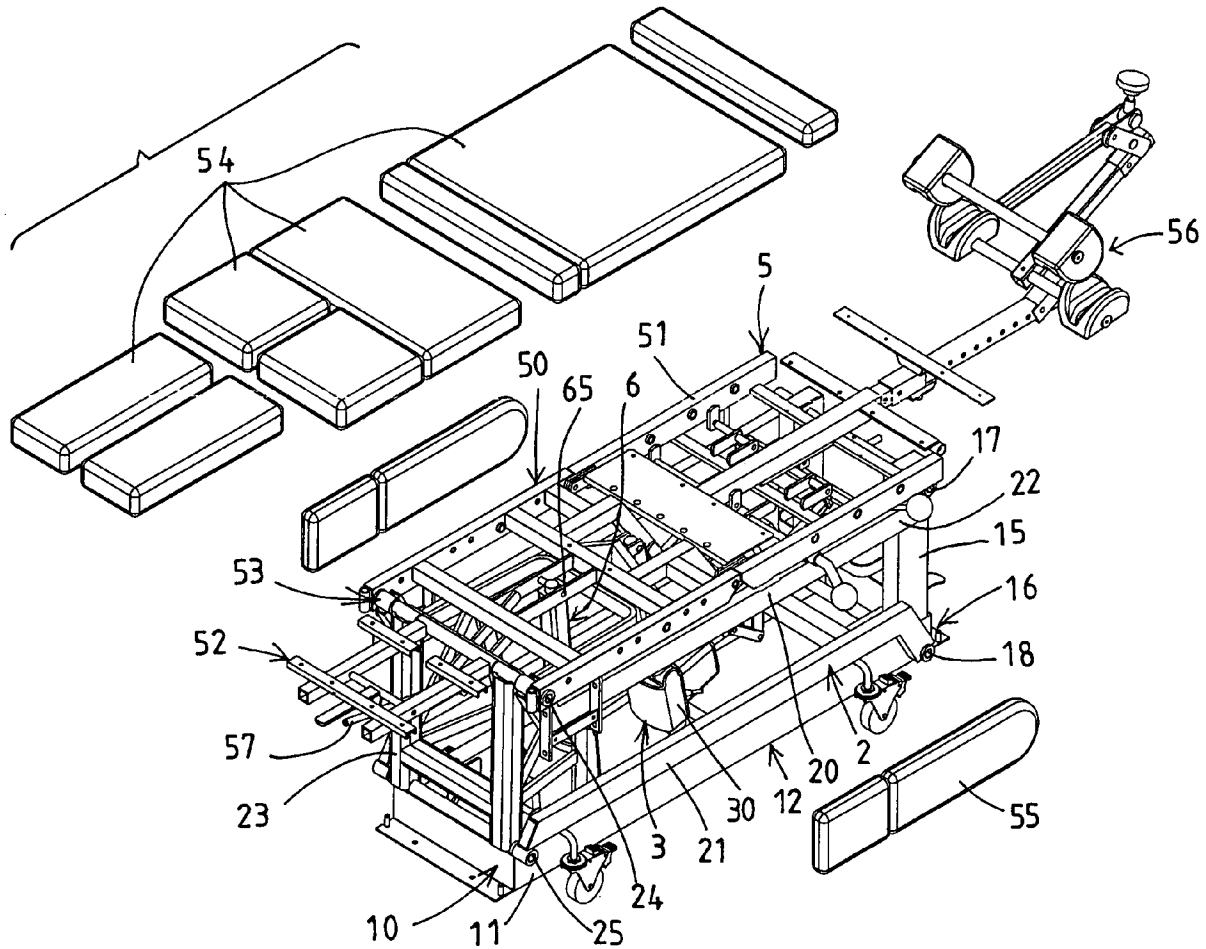
FIG. 2 is a partial exploded view of the patient treatment apparatus.
Figure 3:
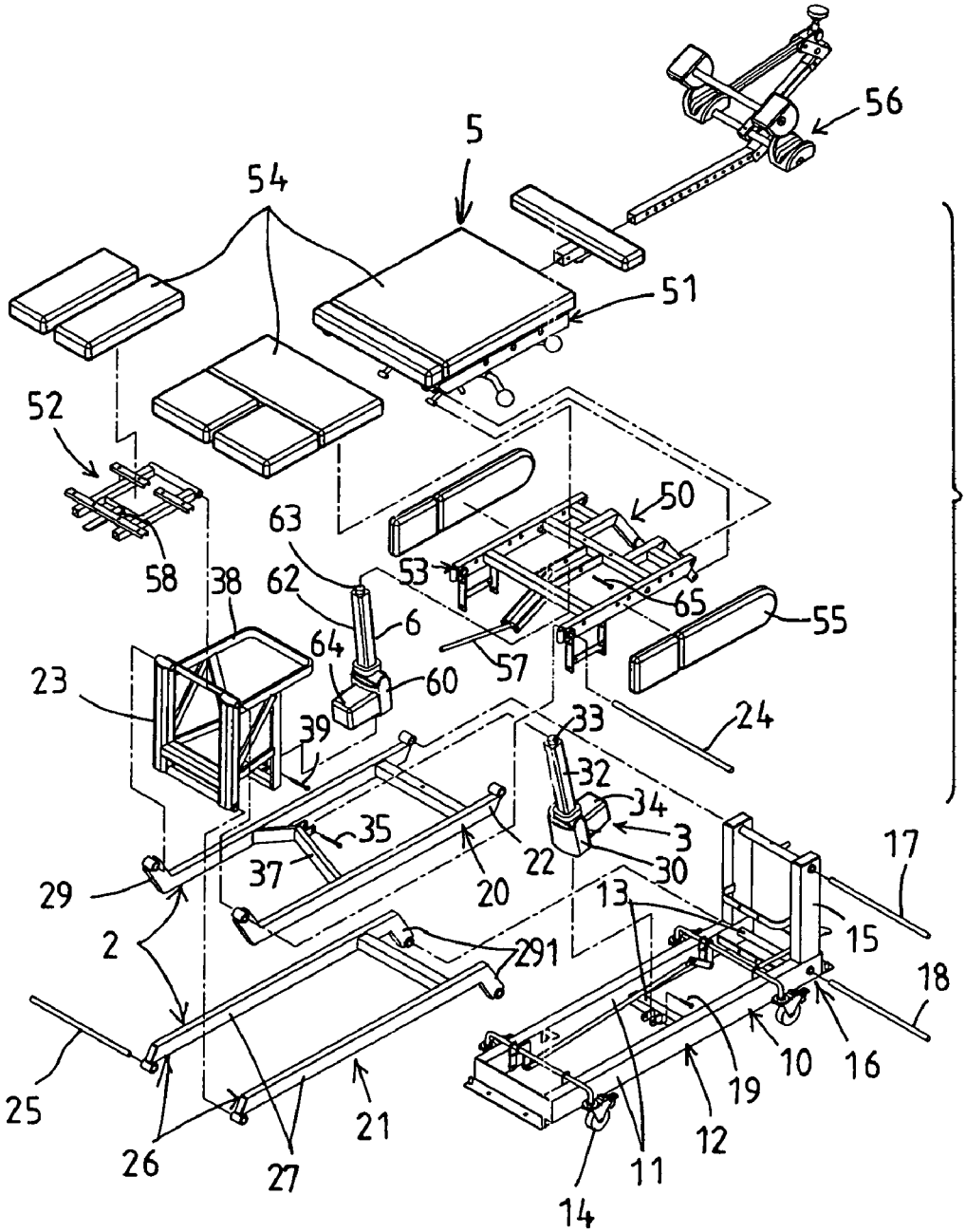
FIG. 3 is another partial exploded view of the patient treatment apparatus.
Figure 4:
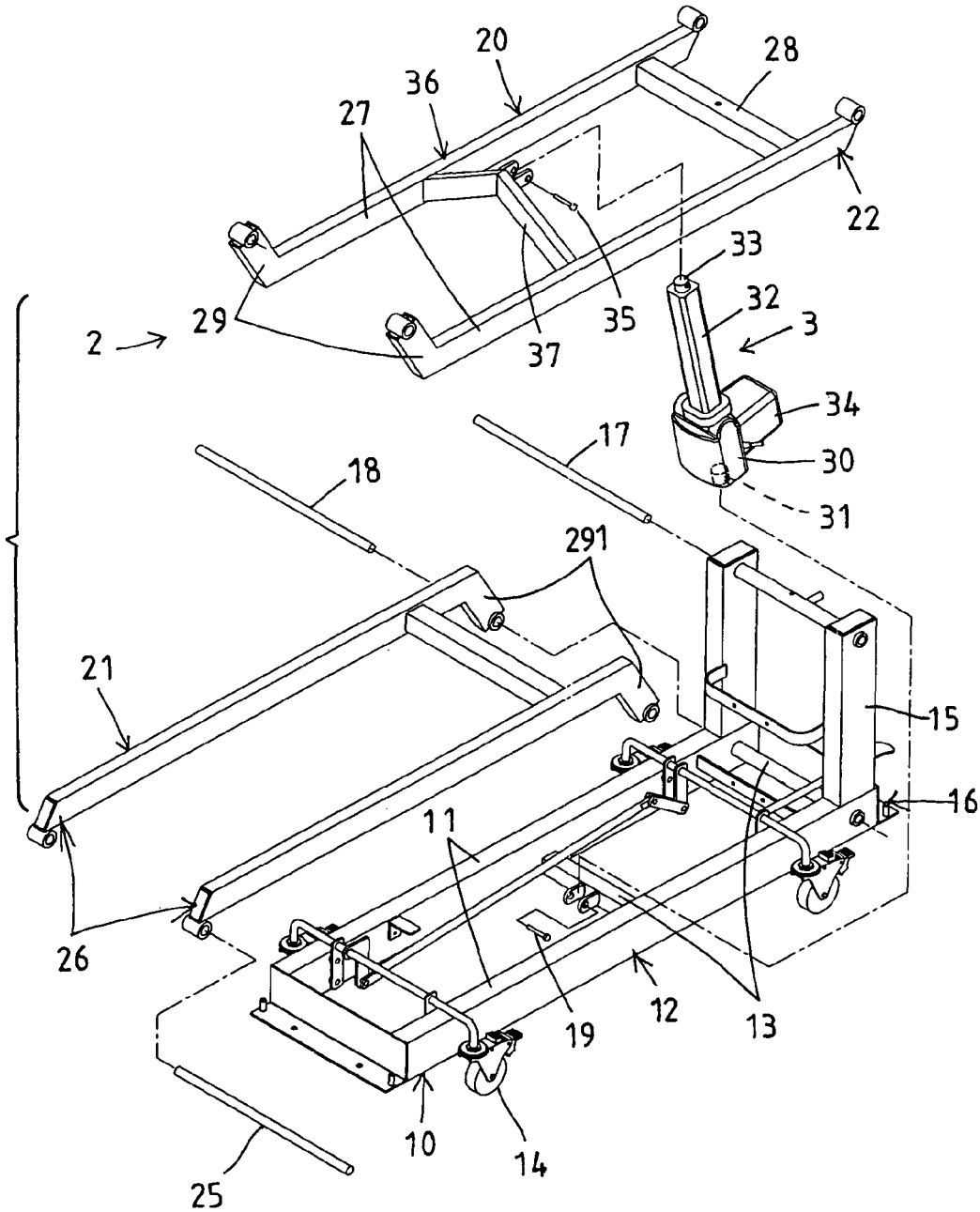
FIGS. 4, 5 are further enlarged partial exploded views of the patient treatment apparatus.
Figure 5:
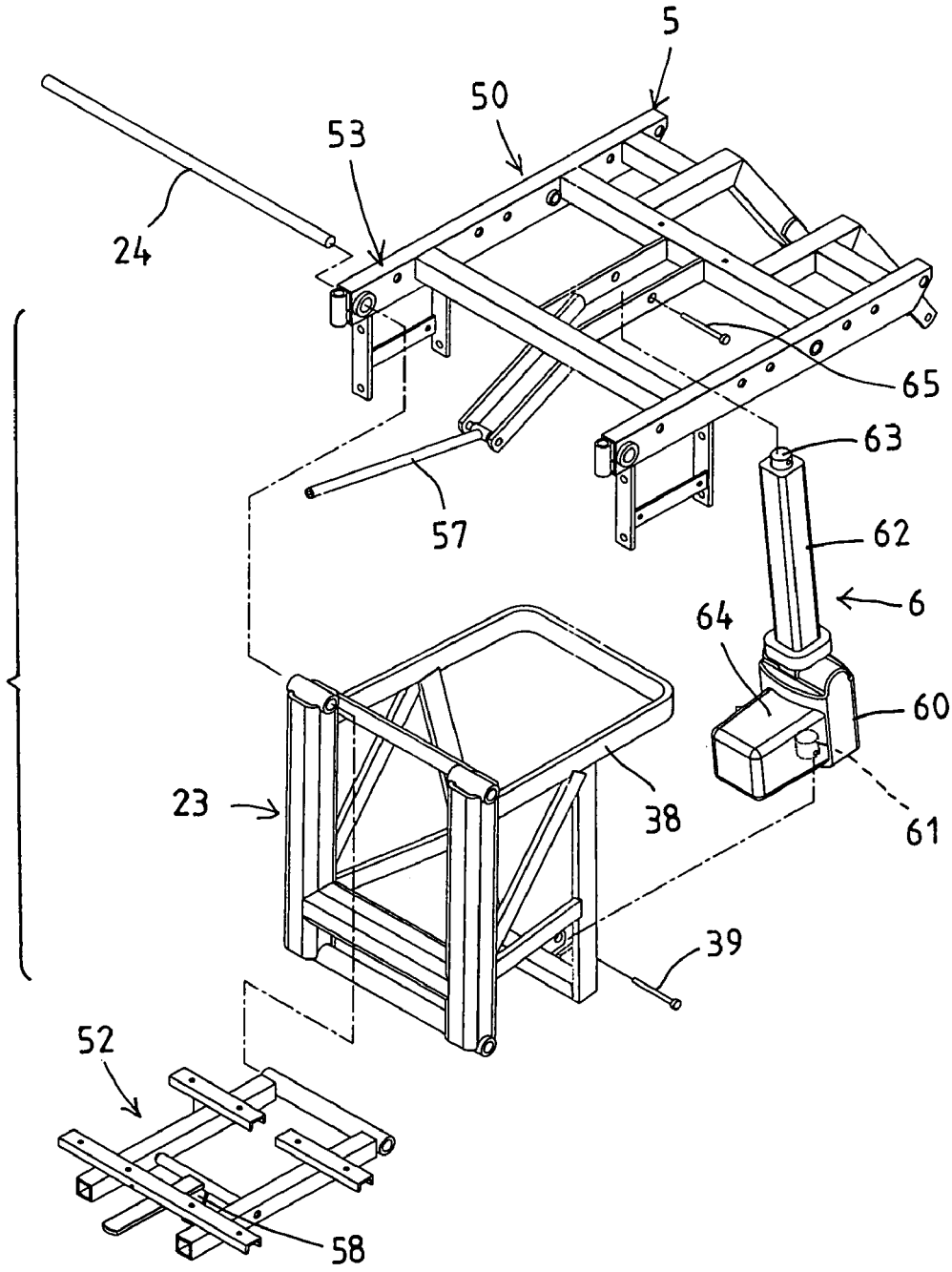

Referring to the drawings, and initially to FIGS. 1-6, a patient treatment apparatus in accordance with the present invention comprises a weighted platform 10 adapted to rest upon a floor and including two side beams 11, and one or more lateral bars 13 coupled between the side beams 11 for securing the side beams 11, together and to form a substantially rectangular structure, one or more wheel devices or wheel members 14 may be attached to the bottom of the platform 10 for allowing the platform 10 to be easily moved everywhere, and each may include a lock device (not shown) for locking the wheel members 14 and for preventing the platform 10 from being moved elsewhere when required.

The platform 10 may further include a column 15 extended upwardly therefrom, such as extended upwardly from the rear portion 16 of the platform 10, and may further include two pivot poles 17, 18 attached thereto, such as attached to the rear portion 16 of the platform 10, and such as attached to the column 15 and arranged one 17 above the other 18, and may further include a pivot pin 19 attached thereto, such as attached to the middle portion 12 or one of the lateral bars 13 of the platform 10. An upper cantilever member 20 and a lower cantilever member 21 are pivotally or rotatably attached or coupled to the platform 10, such as attached or coupled to the column 15 of the platform 10 with the pivot poles 17, 18.

For example, the upper cantilever member 20 and the lower cantilever member 21 each include one end or first end or rear end 22 pivotally or rotatably attached or coupled to the platform 10, such as attached to the column 15 or the rear portion 16 of the platform 10 with the pivot poles 17, 18 respectively, and a bracket 23 pivotally or rotatably attached or coupled to the other end or second end or front end or portion 26 of the cantilever members 20, 21 with pivot axles 24, 25 respectively for allowing the cantilever members 20, 21 and the bracket 23 and the column 15 or the rear portion 16 of the platform 10 to be formed as a parallelogrammic structure or configuration or device 2 and for allowing the cantilever members 20, 21 to be pivoted or rotated up and down relative to the platform 10 with the pivot poles 17, 18.

The cantilever members 20, 21 each may also include two side beams 27, and one or more lateral bars 28 coupled between the side beams 27 for securing the side beams 27, together and to form a substantially rectangular structure (FIGS. 3, 4), and the upper cantilever member 20 may include a bent front segment 29 formed on the front portion 26 of each of the side beams 27, and the lower cantilever member 21 may include a bent rear segment 291 formed on the rear end 22 of each of the side beams 27 and arranged for allowing the bracket 23 to be suitably parallel to the rear column 15 of the platform 10 when the cantilever members 20, 21 are pivoted or rotated up and down relative to the platform 10 with the pivot poles 17, 18.

An elevating transmission device 3 includes a seat 30 having a lower portion 31 pivotally or rotatably attached or coupled to the platform 10, such as attached to the middle portion 12 or one of the lateral bars 13 of the platform 10 with the pivot pin 19, and includes a tube 32 extended upwardly from the seat 30, and a rod 33 slidably received or engaged in the tube 32, and a motor 34 attached or mounted to the seat 30 and coupled to the rod 33 for driving or moving the rod 33 into and out of the tube 32, and the rod 33 is pivotally or rotatably attached or coupled to the parallelogrammic device 2, such as attached to the upper cantilever member 20 for allowing the upper cantilever member 20 of the parallelogrammic device 2 to be elevated or pivoted or rotated up and down relative to the platform 10 by the motor 34 of the elevating transmission device 3.

Figure 7:
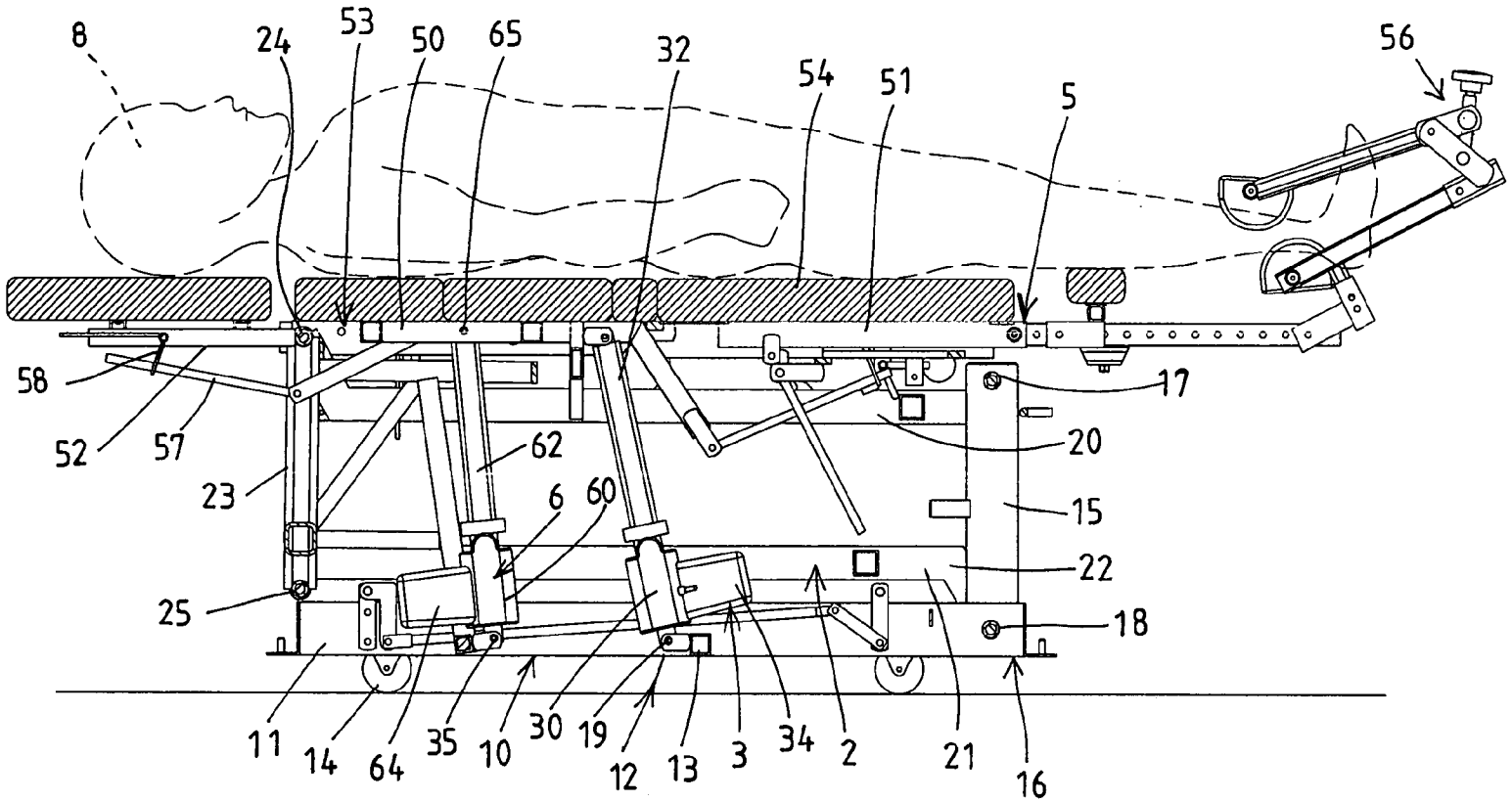
FIGS. 7, 8, 9, 10 are side plan schematic views similar to FIG. 6, illustrating the operation of the patient treatment apparatus.
Figure 8:
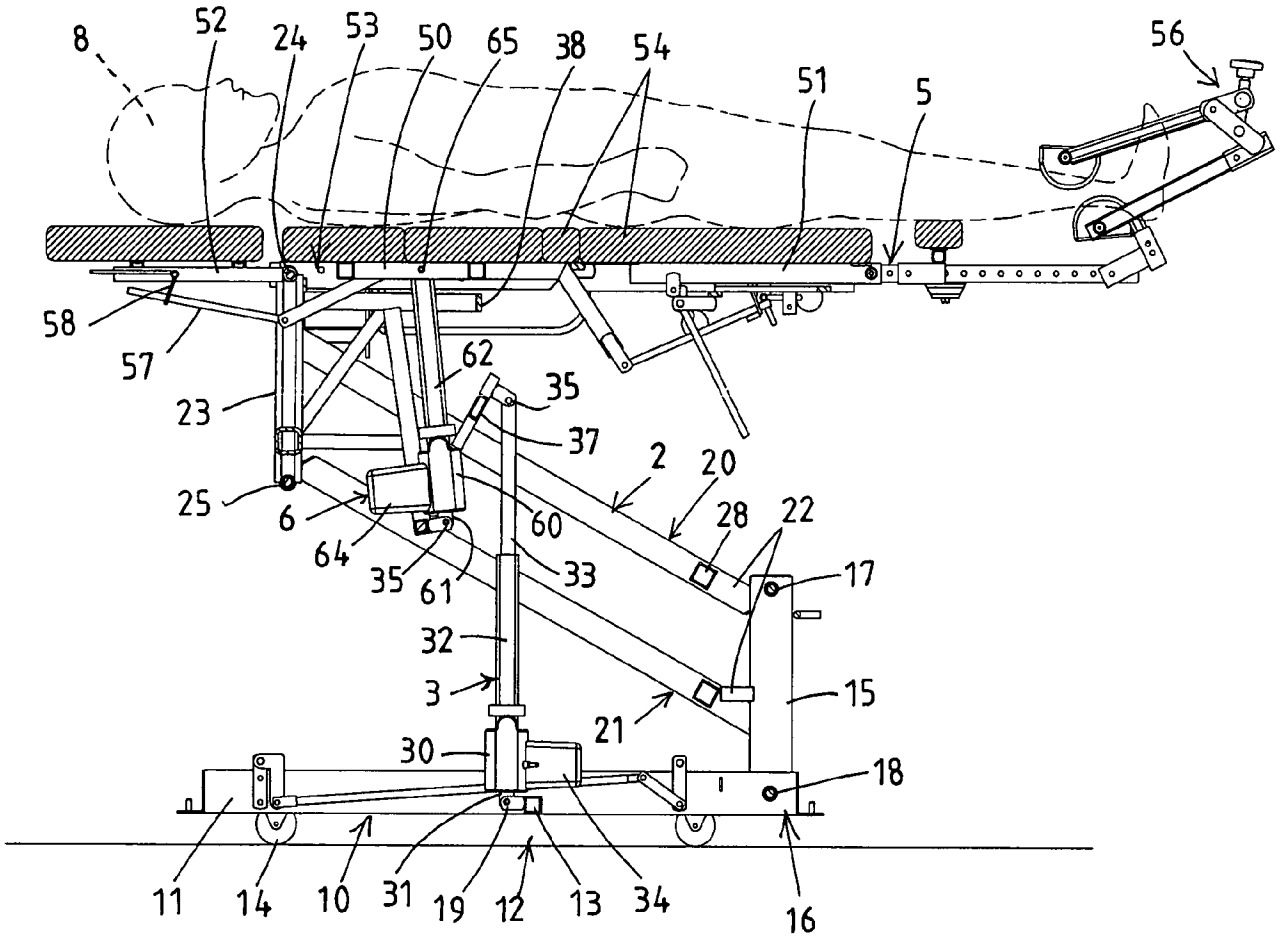
Figure 9:
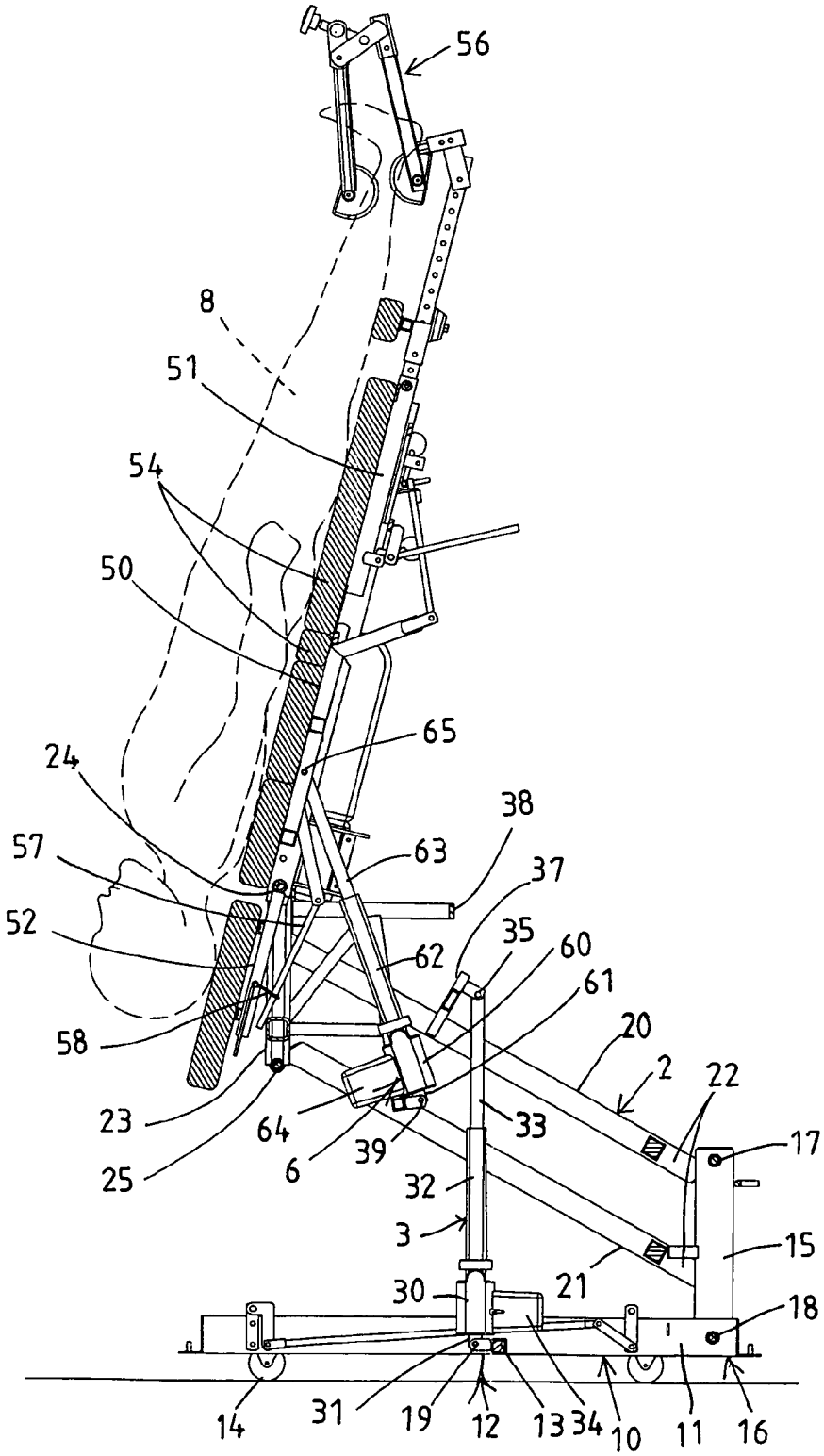
Figure 10:
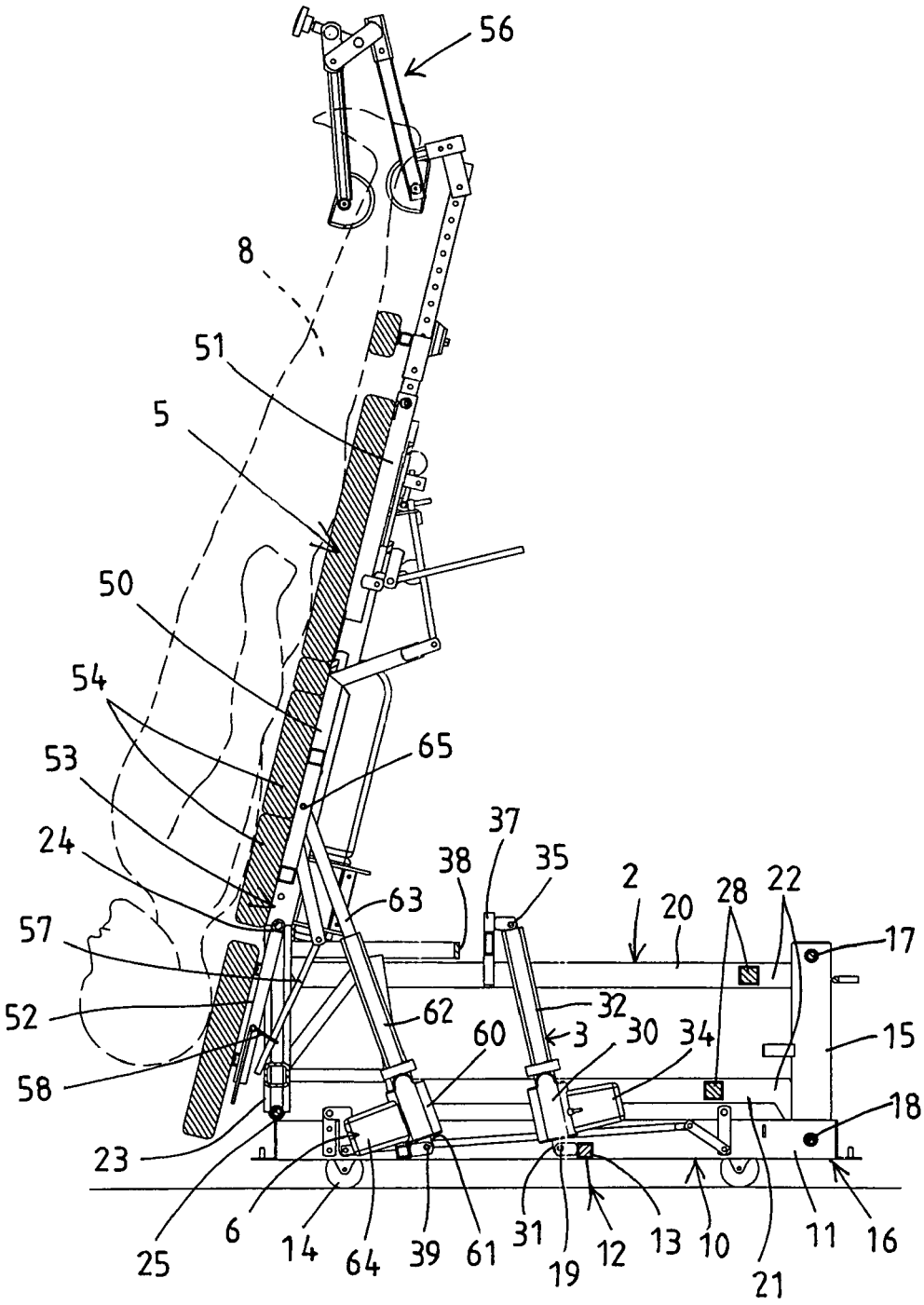

The upper cantilever member 20 may include a pivot pin 35 attached thereto, such as attached to the middle portion 36 or one or the middle lateral bar 37 of the upper cantilever member 20, in which the middle lateral bar 37 includes an upwardly curved or bent structure for attaching the pivot pin 35 and arranged for allowing the pivot pin 35 to be located slightly above the upper cantilever member 20, best shown in FIGS. 8-10, the upper portion of the rod 33 of the elevating transmission device 3 is pivotally or rotatably attached or coupled to the middle portion 36 or one of the lateral bars 37 of the upper cantilever member 20 of the parallelogrammic device 2 with the pivot pin 35 for allowing the upper cantilever member 20 of the parallelogrammic device 2 to be elevated or pivoted or rotated up and down relative to the platform 10 by the motor 34 of the elevating transmission device 3 between the lower rest position (FIGS. 1-2, 6-7 and 10) and the upper working position (FIGS. 8-9).

The bracket 23 includes a framework 38 attached thereto, such as attached to the rear portion of the bracket 23, and includes another pivot pin 39 attached to the framework 38. A patient supporting table 5 includes one or more (such as three) table segments 50, 51, 52 coupled or secured together, and includes a front portion 53 pivotally or rotatably attached or coupled to the bracket 23 of the parallelogrammic device 2 with the pivot axle 24 for allowing the patient supporting table 5 to be pivoted or rotated relative to the parallelogrammic device 2 between the lower rest or horizontal position (FIGS. 1-2, and 6-8) and the tilted or inclined working position (FIGS. 9-10).

A tilting transmission device 6 includes a seat 60 having a lower portion 61 pivotally or rotatably attached or coupled to the bracket 23, such as attached to the framework 38 of the bracket 23 with the pivot pin 39, and includes a tube 62 extended upwardly from the seat 60, and a rod 63 slidably received or engaged in the tube 62, and a motor 64 attached or mounted to the seat 60 and coupled to the rod 63 for driving or moving the rod 63 into and out of the tube 62, and the rod 63 is pivotally or rotatably attached or coupled to the patient supporting table 5, such as attached to one of the table segments 50 of the patient supporting table 5 with a pivot pin 65 for allowing the patient supporting table 5 to be tilted or inclined relative to the bracket 23 of the parallelogrammic device 2 by the motor 64 of the tilting transmission device 6, and between the lower rest or horizontal position (FIGS. 1-2, and 6-8) and the tilted or inclined working position (FIGS. 9-10).

The patient supporting table 5 may further include one or more pads or cushions 54 disposed or attached or mounted on top of the table segments 50, 51, 52 for comfortably supporting the patient or the user 8 thereon, and includes one or more pads or cushions 55 disposed or attached or mounted on the side portions for engaging with the patient or the user 8 and for preventing the patient or the user 8 from falling down from the patient supporting table 5. A foot retaining device 56 may be attached to the rear portion of the patient supporting table 5 for engaging with the feet of the patient or the user 8 and for stably anchoring or retaining the patient or the user 8 on the patient supporting table 5. The front table segment 50 of the patient supporting table 5 may include an extension 57 extended forwardly therefrom for engaging with an ear 58 of the front or head segment 52 and for coupling the front or head segment 52 to the front table segment 50 of the patient supporting table 5.

Figure 6:
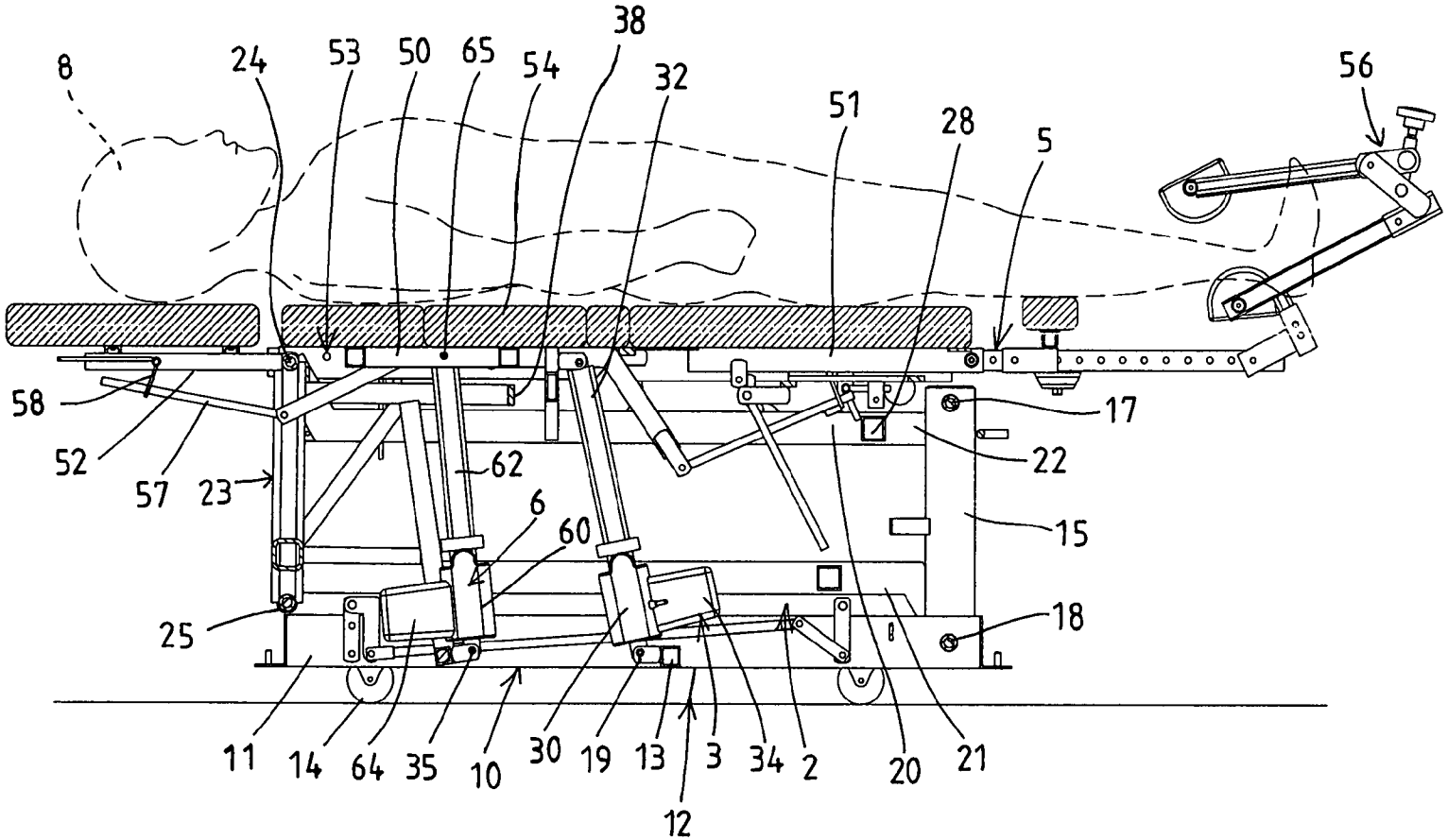
FIG. 6 is a side plan schematic view of the patient treatment apparatus.

In operation, as shown in FIGS. 6-7, the feet of the patient or the user 8 may be stably anchored or retained on the patient supporting table 5 with the foot retaining device 56. As shown in FIGS. 7-9, the upper cantilever member 20 and the lower cantilever member 21 of the parallelogrammic device 2 may be stably elevated or pivoted or rotated up and down relative to the platform 10 by the motor 34 of the elevating transmission device 3. As shown in FIGS. 8-10, the patient supporting table 5 may be tilted or inclined relative to the bracket 23 of the parallelogrammic device 2 by the motor 64 of the tilting transmission device 6 between the lower rest or horizontal position and the tilted or inclined working position.

Accordingly, the patient treatment apparatus in accordance with the present invention includes a stable support for stably elevating the patient supporting table and for preventing the patient supporting table from being tilted or inclined relative to the supporting base and also for preventing the patient from falling down from the patient supporting table inadvertently.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A patient treatment apparatus comprising: a platform including a rear portion, an upper cantilever member and a lower cantilever member pivotally attached and coupled to said rear portion of said platform with pivot poles, and each including a front portion, a bracket pivotally attached and coupled to said front portions of said upper and said lower cantilever members with pivot axles respectively for allowing said upper and said lower cantilever members and said bracket to be formed as a parallelogrammic device and for allowing said upper and said lower cantilever members to be pivoted up and down relative to said platform with said pivot poles, an elevating transmission device including a tube, and a motor-driven rod slidably received and engaged in said tube and coupled between said platform and said parallelogrammic device for pivoting said upper and said lower cantilever members up and down relative to said platform, a patient supporting table including a front portion pivotally attached and coupled to said bracket of said parallelogrammic device for allowing said patient supporting table to be pivoted relative to said parallelogrammic device between a horizontal position and a tilted working position, and a tilting transmission device including a tube, and a motor-driven rod slidably received and engaged in said tube and coupled between said patient supporting table and said parallelogrammic device for tilting said patient supporting table between the horizontal position and the tilted working position.

2. The patient treatment apparatus as claimed in claim 1, wherein said platform includes a column extended upwardly from said rear portion of said platform, and said pivot poles are attached to said column and arranged one above the other.

3. The patient treatment apparatus as claimed in claim 1, wherein said upper cantilever member includes two side beams each having a bent front segment formed on a front portion of each of said side beams.

4. The patient treatment apparatus as claimed in claim 1, wherein said lower cantilever member includes two side beams each having a bent rear segment formed on a rear portion of each of said side beams.

5. The patient treatment apparatus as claimed in claim 1, wherein said elevating transmission device includes a seat having a lower portion pivotally attached and coupled to said platform with a pivot pin, and said tube is extended upwardly from said seat and said rod is slidably received and engaged in said tube and coupled to said parallelogrammic device.

6. The patient treatment apparatus as claimed in claim 5, wherein said parallelogrammic device includes a lateral bar attached to said upper cantilever member for supporting said pivot pin.

7. The patient treatment apparatus as claimed in claim 6, wherein said lateral bar includes an upwardly bent structure for supporting said pivot pin above said upper cantilever member.

8. The patient treatment apparatus as claimed in claim 1, wherein said tilting transmission device includes a seat having a lower portion pivotally attached and coupled to said bracket with a pivot pin, and said tube is extended upwardly from said seat and said rod is slidably received and engaged in said tube and coupled to said patient supporting table.

9. The patient treatment apparatus as claimed in claim 8, wherein said bracket includes a framework attached to said bracket for supporting said pivot pin.

10. The patient treatment apparatus as claimed in claim 1, wherein said patient supporting table includes a foot retaining device attached to said patient supporting table for engaging with a user's feet and for anchoring and retaining the user on said patient supporting table.

11. The patient treatment apparatus as claimed in claim 1, wherein said patient supporting table includes a table segment having a front portion pivotally attached and coupled to said bracket of said parallelogrammic device with said pivot axle, and includes a head segment coupled to said table segment.

12. The patient treatment apparatus as claimed in claim 11, wherein said table segment includes an extension extended forwardly therefrom for engaging with an ear of said head segment and for coupling said head segment to said table segment.

* * * * *